US011492089B2

(12) United States Patent
Gai et al.

(10) Patent No.: US 11,492,089 B2
(45) Date of Patent: Nov. 8, 2022

(54) DEVICE FOR FASTENING STEERING ACTUATOR CYLINDERS TO OUTBOARD MARINE MOTORS AND DUAL-ACTING ACTUATOR CYLINDER FOR OUTBOARD MARINE MOTORS

(71) Applicant: Ultraflex S.p.A., Casella (IT)

(72) Inventors: Marcella Gai, Busalla (IT); Enrico Pagani, Crocefieschi (IT)

( * ) Notice: Subject to any disclaimer, the term of this patent is extended or adjusted under 35 U.S.C. 154(b) by 0 days.

(21) Appl. No.: 17/105,570

(22) Filed: Nov. 26, 2020

(65) Prior Publication Data

US 2021/0163110 A1 Jun. 3, 2021

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS 4,109,978 A * 8/1978 Ernst ..... H02K 5/167 384/282
4,932,795 A 6/1990 Guinn
6,341,991 B1 * 1/2002 Ogino ..... B63H 20/12 440/52
2011/0049834 A1 3/2011 Natu

FOREIGN PATENT DOCUMENTS

EP 2641828 9/2013

* cited by examiner

*Primary Examiner* — Stephen P Avila
(74) *Attorney, Agent, or Firm* — Themis Law

(57) ABSTRACT

A device for fastening a steering actuator cylinder to an outboard marine motor includes a fastening rod insertable inside the outboard marine motor and having ends each inserted inside a corresponding housing seat obtained in a terminal element, so that the fastening rod has a relative rotation with respect to the terminal elements, which are further fastened to the steering cylinder. The outboard motor is integral with the fastening rod, so that the outboard motor can oscillate around the longitudinal axis of the fastening rod. At least one insulating element is interposed between each end of the fastening rod and the corresponding housing seat, the insulating element is configured to at least partially surround the surface of each end.

8 Claims, 4 Drawing Sheets

DEVICE FOR FASTENING STEERING ACTUATOR CYLINDERS TO OUTBOARD MARINE MOTORS AND DUAL-ACTING ACTUATOR CYLINDER FOR OUTBOARD MARINE MOTORS

FIELD OF THE INVENTION

The present invention relates to a device for fastening steering cylinders to outboard marine motors of a vessel.

The device comprises a fastening rod insertable inside an outboard motor, the rod having each of the ends thereof inserted inside a corresponding housing seat, obtained in a terminal element, such that the fastening rod has a relative rotation with respect to the terminal elements.

BACKGROUND OF THE INVENTION

As in the systems known in the art, the terminal elements are in turn fastened to the cylinder.

Furthermore, the outboard motor is integral with the fastening rod, such that it can oscillate around the longitudinal axis of said fastening rod.

What is described above is the common configuration for fastening steering cylinders to the outboard motors of a vessel, in which the cylinder is used as a steering member of the outboard motor, which motor is fastened to the vessel.

According to this configuration, the cylinder rod, i.e., the fastening rod, is fastened with the ends thereof inside two "bull-horns", the terminal elements.

The rod of the cylinder must be able to rotate around the longitudinal axis thereof, so as to allow the rotation, i.e., the tilt, of the outboard motor with respect to the bull-horn and with respect to the rest of the vessel.

The interface between the ends of the cylinder rod and the terminal elements is a particularly critical area, since the rod and the terminal elements, i.e., the bull-horns, are generally made of metal, thus a galvanic bridge is created which causes the rotation of the rod to be blocked due to the formation of oxide on the rod, particularly at the ends thereof and/or on the bull-horns.

The galvanic effect is further amplified if the rod is made of steel and the bull-horns of aluminum.

In fact, it must be considered that the rod is the point of contact between the motor and the cylinder, so that the vessel, connected to the outboard motor, acting as a negative pole, amplifies the galvanic bridge effect.

This effect is further amplified in particularly humid and highly saline environments, which are particularly frequent in the case of vessels.

The accumulation of oxide at the ends of the rod compromises the relative movement of the latter with respect to the terminal elements, preventing the tilt of the outboard motor.

However, the tilt control of the outboard motor is powerful enough to disrupt the connections between the cylinder and the outboard motor, bending the connecting arms and wearing out the various components, with the locking of the cylinder rod.

Therefore, the accumulation of oxide caused by the galvanic bridge compromises the correct operation of the motor tilt mechanism, but the operation of the systems known in the state of the art has a further defect related to wear.

In fact, the relative movement between the rod and the bull-horns can cause the wear or tear of the ends of the cylinder rod or of the terminal elements, depending on the materials with which they are made. Currently the ends of the fastening rod are covered with grease, however with the use of the vessel, the layer of grease is removed and the lubricating effect disappears.

For this reason, currently some known systems in the state of the art provide for the use of a device adapted to continuously deposit grease on the fastening rod.

These systems are particularly ineffective, as the deposit of grease does not always occur optimally and within the required times and also adds a component which can fail and make the steering/propulsion part of the vessel even more complex from a constructive point of view.

There is therefore a need, not satisfied by the devices known in the state of the art, to provide an outboard marine motor fastening device, which allows to solve the disadvantages described above, avoiding the blockage of the outboard motor tilt control.

SUMMARY OF THE INVENTION

The present invention achieves the above purposes by providing a fastening device as described above, in which at least one insulating element is provided interposed between each end of the fastening rod and the corresponding housing seat.

Furthermore, the insulating element is configured to at least partially surround the surface of each end.

Preferably, given the currently known configurations, in which the end of the rod is the male element, inserted inside the corresponding housing seat, the insulating element surrounds, at least equally, the outer surface of each rod end.

For example, the insulating element can be made of plastic.

The device object of the present invention therefore includes inserting an insulating element so as to galvanically insulate the rod with respect to the terminal elements and so as to decrease the wear of the latter.

Furthermore, the provision of the insulating element in plastic, especially in particularly inert polymers, allows, in addition to galvanically insulating the rod, to further limit wear during the rotation of the rod inside the housing seats of the terminal elements.

According to a possible embodiment, two insulating elements are included for each end, the two insulating elements being spaced apart along the longitudinal axis of the fastening rod and lubricating material being interposed between the two insulating elements.

This configuration allows the lubricating material to be retained between the two insulating elements, so that it is not dispersed during the rotation of the rod as in the systems known in the state of the art.

According to a possible embodiment, the insulating element is formed by a bushing element.

According to a preferred embodiment, the insulating element is fastened to the inner walls of the housing seat, so as to be integral with the terminal element and allow the rotation of the fastening rod.

Such configuration allows to further decrease wear.

In fact, in the systems known in the state of the art, it is the bull-horn, i.e., the terminal element, which is the component which tends to wear out most, due to the fact that it is made of aluminium, which deteriorates more than steel during the rotation of the rod.

Therefore, the insulating element fitted in the housing seat of the terminal element allows to preserve the walls of the housing seat, greatly limiting the wear of the latter.

According to a possible embodiment of the device object of the present invention, the housing seat consists of a through-hole obtained in the thickness of the terminal element, while the insulating element has a length equal to the length of the through-hole.

It is evident that the insulating element may have a length such as to entirely overlap the part of the fastening rod which may be in contact with the inner walls of the housing seats of the terminal elements.

The presence of the insulating element also allows to provide a sort of guide, which avoids unexpected oscillations of the fastening rod during the rotation thereof.

In particular, the insulating element prevents oscillations of the rod if the ends of the latter wear: in fact, wear increases the clearance between the rod and the terminal elements, thus by decreasing wear, these clearances decrease.

In view of the advantageous aspects described with regard to the fastening device, the present invention also relates to a double-acting actuator cylinder for outboard marine motors.

In particular, the outboard marine motors connected to said actuator cylinder have a fastening device to the transom of a vessel provided according to one or more of the features described above.

Furthermore, the present invention relates to a dual-acting actuator cylinder for outboard marine motors comprising an electronic unit for generating/transmitting electrical control signals of the cylinder.

The actuator cylinder object of the present invention is generally used in steer by wire type guidance systems, i.e., those systems with an electronic control unit which detects the movement of a control member, such as the rotation of the steering wheel, to generate a command signal to be sent to said cylinder, which deals with the positioning of the outboard motors of a vessel, so as to set the navigation route thereof.

Therefore, the electronic unit is responsible for processing the detected data and generating command signals, processing which occurs through one or more electronic processing boards.

In the systems known to the state of the art, the electronic processing board is generally inserted inside an outer casing and has a terminal of an electric transmission cable, covered by an insulating sheath, welded to the board itself.

Furthermore, the outer casing is generally filled with an insulating material of the resin type or the like.

As will be evident from the illustration of an embodiment described below, the connection of the terminal of the electrical cable to the electronic board is a critical area for the maintenance of the systems known in the art.

In fact, since the cable exits the outer casing, it is likely that a possible user will get caught or stumble in the loops made by the cable, tearing the latter at the weakest point, i.e., in the area of connection to the electronic board.

Furthermore, the connection between the cable terminal and the electronic board is a critical area not only for the risk of tears or breakage which would require the replacement of components, but also for the problem of moisture.

In fact, the moisture climbs up the cable, runs through the outer sheath and penetrates the outer casing, depositing on the terminals of the cable welded to the electronic board, deteriorating this welding and the consequent contact.

The outer sheath is in fact made of soft rubbery material, while the resin tends to harden over time: the rubber need only recede, for example due to external agents such as sun, water or salt, to generate a gap in which the moisture penetrates, deteriorating the welded contacts of the cable terminal.

To solve these disadvantages, the cylinder object of the present invention has a welded cable terminal locking element, which has an "omega"-shaped profile, with a central curved part and two flat lateral fins.

This locking element is therefore fastened to the outer casing through the lateral fins, so as to overlap with the central curved part of the sheath of the electrical cable terminal and provide a locking seat of the terminal itself.

According to a possible embodiment, the locking seat provided by the locking element has a smaller section with respect to the section of the cable terminal.

The omega-shaped element thereby crushes the cable towards the electronic board, eliminating the possible gap which was formed between the rubber and the outer sheath of the cable.

Furthermore, the locking action also limits the possibility that the rubber of the outer sheath will recede over time.

In order to increase the pressure and locking action of the locking element towards the cable terminal, according to a refinement the locking seat has at least one raised tooth, which extends in the direction of the terminal.

Advantageously, the locking element has a thickness of less than one millimeter.

Furthermore, the locking element is preferably made of aluminum R.

Due to this configuration, the locking element can be fastened to the electronic board or the outer casing, so as to crush the cable terminal as described above, but beyond a certain pressure level it can deform, to best adapt to the shape of the cable and recreate the profile of the latter, to avoid the formation of gaps in which moisture can insinuate.

Lastly, according to a further embodiment, the actuator cylinder described can have a device for fastening to the transom of a vessel, which device is provided according to one or more of the features described above.

BRIEF DESCRIPTION OF THE DRAWINGS

These and other features and advantages of the present invention will become clearer from the following description of some exemplary embodiments illustrated in the attached drawings in which.

It should be noted that the fastening devices depicted in the enclosed figures are shown to better understand the advantages and features of the claimed device and cylinder.

These figures, therefore, are presented to illustrative without limiting purposes the inventive concept of the present invention, i.e., that of providing a fastening device of an outboard marine motor at the stern of a vessel, which avoids the blocking of the tilt movement of the motor.

Furthermore, while in the attached figures the insulating element consists of a bushing element, one or more insulating elements per end, provided for example by gaskets or similar elements, can also be provided without altering the scope and breadth of the present invention.

DETAILED DESCRIPTION OF EMBODIMENTS OF THE INVENTION

Figure 1:
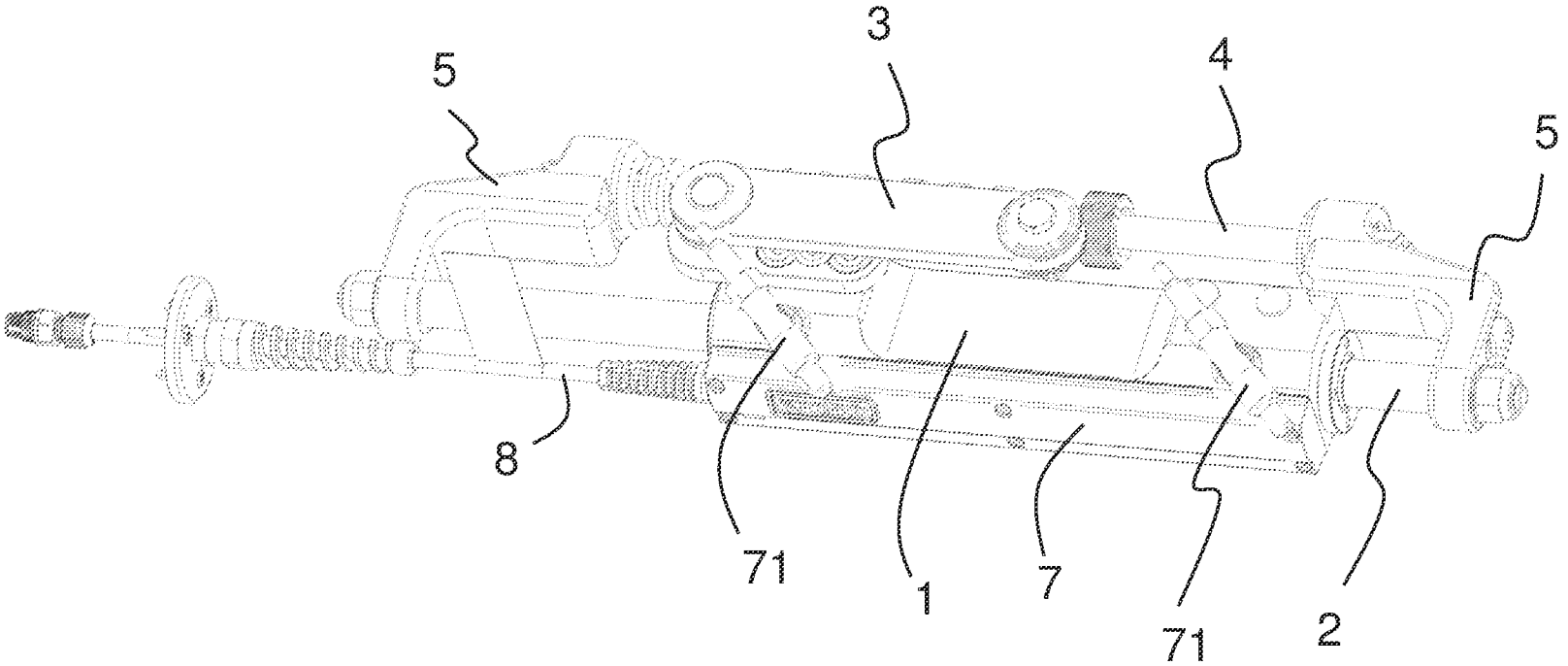
Fig. 1 (Prior Art)
FIG. 1 shows a perspective view of an actuator cylinder known in the art.

With particular reference to FIG. 1, a dual-acting actuator cylinder according to the state of the art is shown.

The cylinder shown in FIG. 1 is used in the steering devices of a vessel, in particular for outboard marine motors.

The outboard motors are fastened to the transom of a vessel so as to be mounted rotatably, around a substantially vertical steering axis, through the fastening device object of the present invention, which will be described below.

To achieve the steering effect, the cylinder 1 is slidably mounted on at least one stem 2 coaxial to the cylinder 1.

Furthermore, a return arm 3 is fastened to the motor and integral with the cylinder 1, for the transmission of the movement of the cylinder 1 to the motor and to obtain the consequent steering movement.

In fact, the translation of the cylinder 1 along the stem 2 allows the rotation of the motor around a vertical axis thanks to the presence of the return arm 3 which transmits the movement of the cylinder 1 to the motor.

Furthermore, the stem 2 is connected to a fastening device, object of the present invention, of the cylinder 1 to the motor, in a non-sliding manner and so as to allow the relative rotation of the motor with respect to the transom, according to an axis parallel to the axis of the stem 2, the so-called tilt movement of the motor.

In particular, the cylinder-stem system is inserted at least in part inside a corresponding insertion seat belonging to the outboard motor.

The outboard motor is not shown in the figures to better show the fastening device of the stem-cylinder system to the motor, consisting of a fastening rod 4 which is inserted at least in part inside a special seat of the outboard motor, which is integral with this fastening rod 4, so that the rotation of the fastening rod 4 around the longitudinal axis thereof allows the tilt movement of the outboard motor.

Figure 2A:
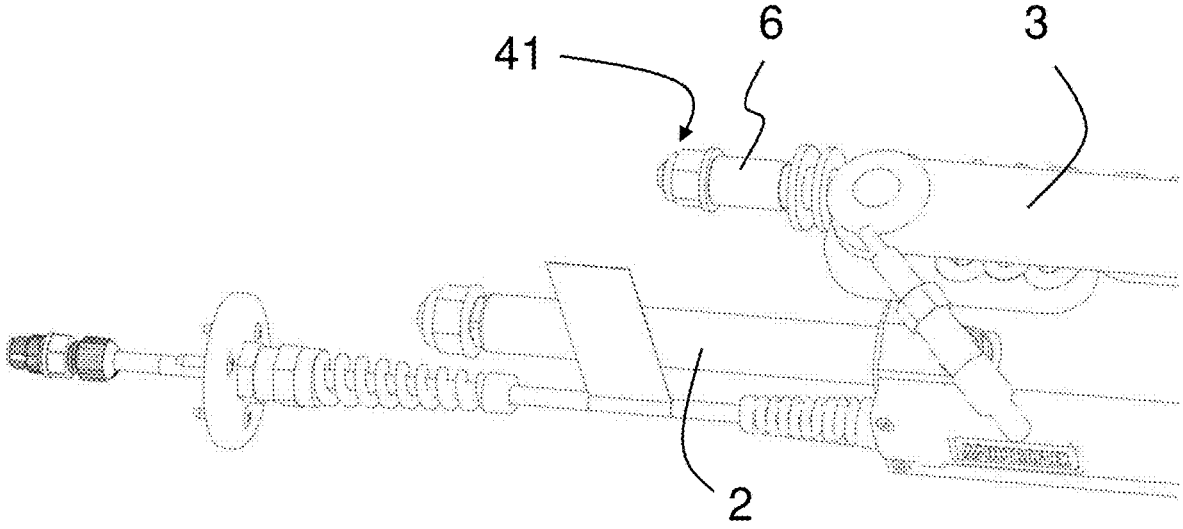
FIGS. 2*a* and 2*b* also show a fastening device according to the present invention.
Figure 2B:
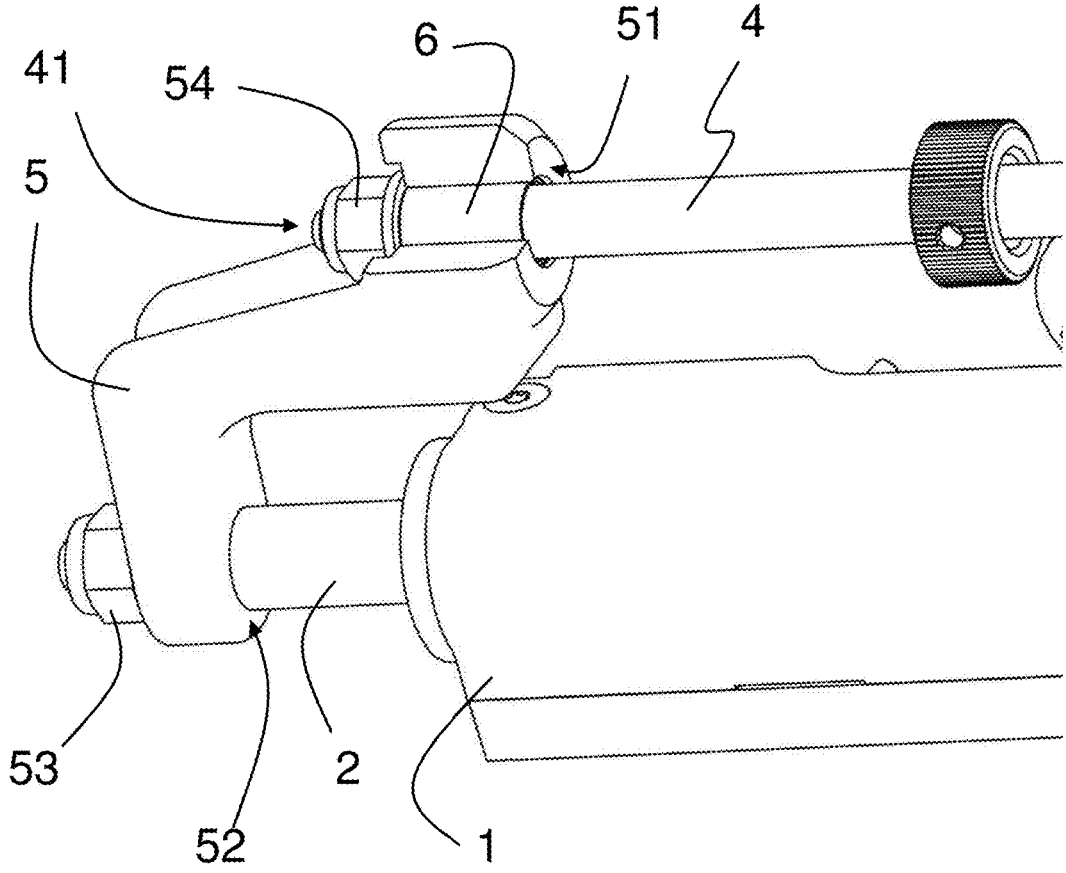

The fastening rod 4 is illustrated in particular in FIGS. 2*a* and 2*b* and has two ends 41.

It should be noted that FIGS. 2*a* and 2*b* only show one end 41, but the fastening device object of the present invention has a symmetrical construction, whereby the ends 41 are provided in the same way.

In particular, the fastening device object of the present invention has two terminal elements 5, such that each terminal element 5 has a first housing seat 51 for inserting the end 41 of the fastening rod 4.

Furthermore, each terminal element 5 has a second housing seat 52 for inserting a corresponding end of the stem 2.

Both the first 51 and the second 52 housing seats are provided through through-holes obtained in the thickness of each terminal element 5, such that the ends of the stem 2 and the ends 41 of the fastening rod 4 are inserted completely inside the respective housing seats 52 and 51, protruding by a certain portion.

Thereby, the portion of the stem 2 and of the fastening rod 4 protruding with respect to the terminal element 5, can be coupled to clamping nuts, respectively 53 and 54, for locking the stem 2 and the rod 4.

It should be noted that the stem 2 is locked and has no relative movement with respect to the terminal element, neither translation nor rotation, while the fastening rod 4 is locked so that it cannot move with respect to the terminal element 5, while it can rotate with respect to this terminal element.

In particular, there is a bushing element 6 interposed between the end 41 and the inner walls of the housing seat 51 of the terminal element 5.

According to the variant shown in FIGS. 2*a* and 2*b*, the bushing element 6 has a length such as to completely cover the part of the end 41 inside the housing seat 51.

Furthermore, the bushing element 6 is made of plastic to electrically insulate the end 41 from the inner walls of the housing seat 51, i.e., to electrically insulate the fastening rod 4 with respect to the terminal element 5.

Advantageously, the bushing element 6 consists of an inert plastic polymer, so as to facilitate the rotation of the fastening rod 4 with respect to the terminal element 5, preventing the surfaces of the end 41 or the inner walls of the housing seat 51 from wearing.

In FIG. 2*a*, the bushing element 6 is illustrated fitted on the end 41, so as to overlap with the outer surface of the fastening rod 4, however preferably, the bushing element 6 is fitted on the inner walls of the housing seat 51 of the terminal element 5.

According to this configuration, the bushing element 6 is integral with the terminal element 5, so it does not rotate in combination with the fastening rod 6, but it is the end 41 which rotates inside the bushing element 6, which remains fastened.

The fastening element described and shown in FIGS. 2*a* and 2*b* can be provided in combination with any actuator cylinder for outboard marine motors, whether a hydraulic, mechanical, electro-hydraulic or electro-mechanical cylinder, without including constructive modifications to the fastening rod 4 or the terminal element 5.

With particular reference to FIG. 1, the cylinder 1 is electrically activated, through control signals generated by an electronic unit comprising an outer casing 7 inside which there is an electronic board 70 (FIGS. 3 and 4) adapted to generate or transmit control signals for the movement of the cylinder 1 depending on the information received through the electric transmission cable 8.

For example, the transmission cable 8 may be connected to a motion detection unit of a vessel control member, such as a steering wheel, which transforms the rotation of the steering wheel into electrical or data signals, transmitted through the cable 8 to the electronic board 70.

The electronic board 70 processes these signals and drives the actuators 71 to move the cylinder 1.

Alternatively, the processing can take place upstream of the electronic board 70, which can deal with the simple transmission of the activation command of the actuators 71, based on the data already processed and received through the cable 8.

Figure 3:
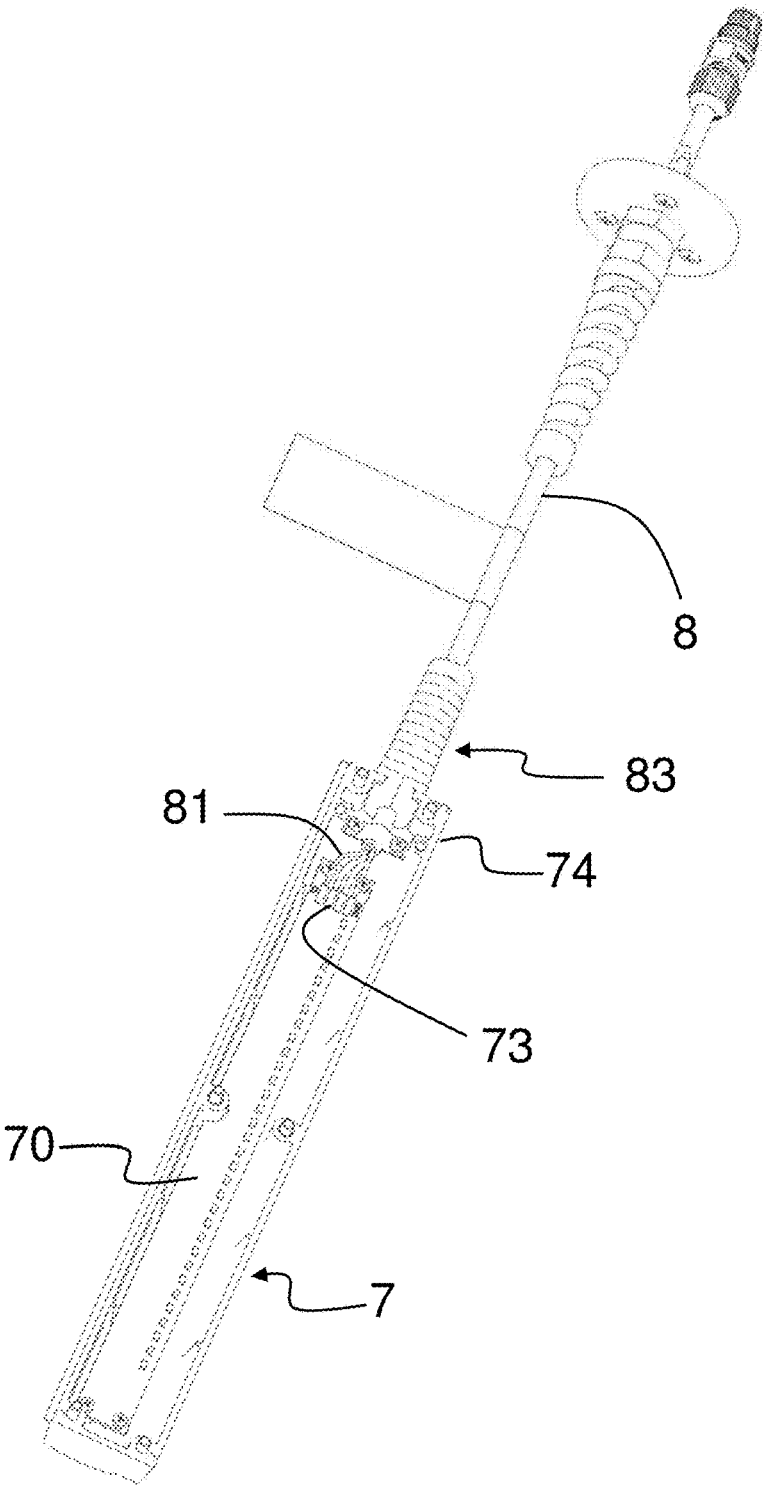
FIGS. 3 and 4 show two views of an actuator cylinder according to the present invention.
Figure 4:
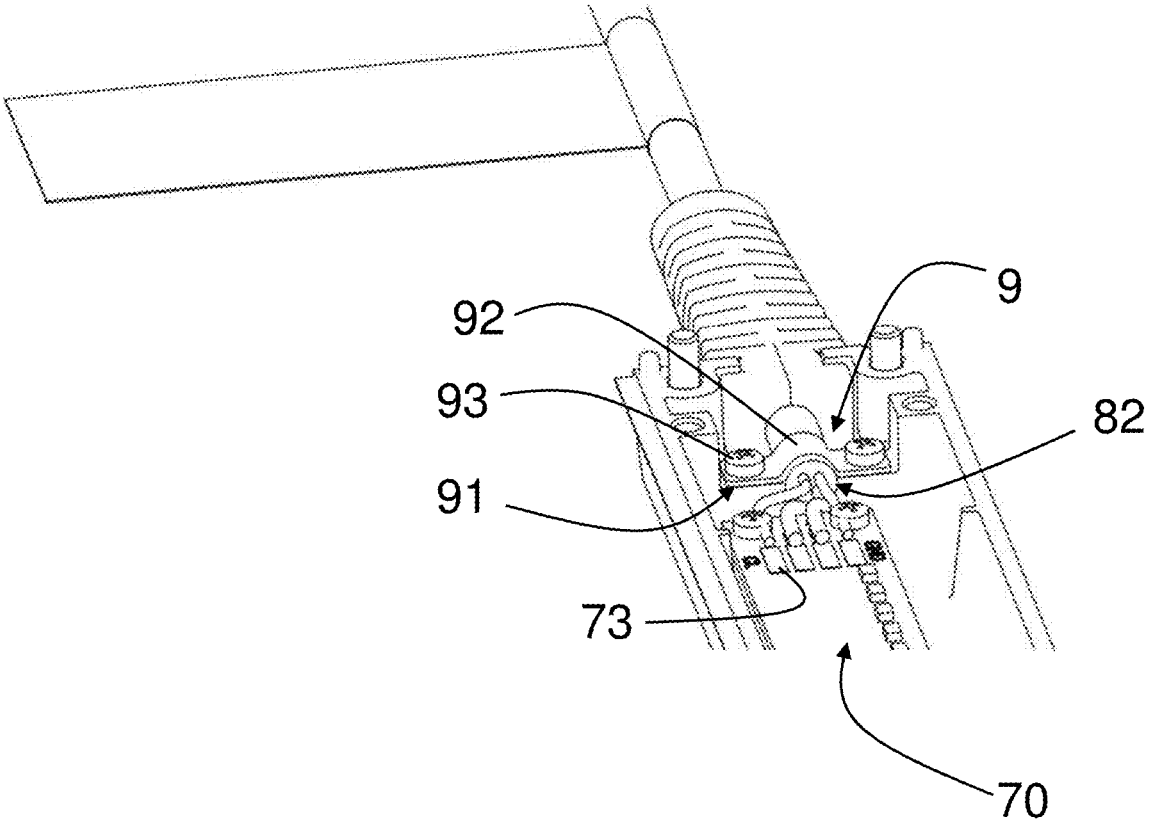

FIGS. 3 and 4 show a particular configuration of the connection area between the cable 8 and the electronic board 70.

It should be noted that according to a preferred embodiment variant, all the contents of the outer casing 7 are embedded inside insulating material, such as resins or the like, not shown in the figures for simplicity of display.

With particular reference to FIGS. 3 and 4, the terminal of the cable 8 is welded to the electronic board 70, through the contacts 73: the cable 8 is in fact covered by an insulating sheath 82, which is removed in the terminal part, to allow the wires of conductive material 81 of the cable 8 to be welded to the contacts 73 of the electronic board 70.

As shown in FIGS. 3 and 4, near the terminal of the cable 8, in particular at the interface area between the cable 8 and the outer casing 7, a protective element 83 is provided, made of a rubber sleeve which covers the cable 8, in particular the insulating sheath 82.

This rubber sleeve is fastened to the outer casing 7 through a shape coupling: in fact, the protection element 83 has an H-shaped terminal which couples to the initial part 74 of the outer casing 7, which has surfaces with a profile complementary to the H-shaped terminal, as clearly shown in FIG. 3.

Furthermore, the transmission cable 8 is firmly locked with respect to the outer casing 7, thanks to the presence of a locking element 9 of the terminal of the cable 8.

The locking element 9 has an "omega"-shaped profile, with a central curved part 92 and two flat lateral fins 91.

As clearly shown in FIG. 4, the two lateral fins 91 may be attached either to the electronic board 70, or to the inner walls of the outer casing 7, depending on constructive needs.

Preferably tightening screws 93 are used, screwed into the thickness of the walls of the outer casing 7 or of the electronic board 70.

The central curved portion 92 overlaps the outer sheath 82, so as to identify a locking seat for the terminal of the cable 8.

In particular, the locking element 9 is configured such that the locking seat has a smaller section than the terminal section of the cable 8.

It follows that the locking element 9 crushes the terminal of the cable 8 towards the electronic board 70.

Depending on the dimensions of the locking element 9, not only the outer sheath 82, but also the wires of conductive material 81 of the cable 8 may deform.

In order to increase the locking of the terminal of the cable 8, the central curved portion 92 may have one or more raised teeth, extending in the direction of the insulating sheath 82.

These teeth will have a shape such as to crush the insulating sheath 82, without damaging or penetrating it, so as to keep the insulation of the cable 8 unchanged.

Lastly, it should be noted that the locking element is made of metal material, preferably aluminum, which has a thickness of about 1 mm, so that it can deform if subjected to high pressures, without damaging the electronic board 70 or the interface between the lateral fins 91 and the tightening screws 93.

While the invention is susceptible to various modifications and alternative constructions, some preferred embodiments have been shown in the drawings and described in detail.

It should be understood, however, that there is no intention of limiting the invention to the specific illustrated embodiment but, on the contrary, it aims to cover all the modifications, alternative constructions, and equivalents falling within the scope of the invention as defined in the claims.

The use of "for example", "etc.", "or" refers to non-exclusive non-limiting alternatives, unless otherwise stated.

The use of "includes" means "includes but not limited to", unless otherwise stated.

What is claimed is:

1. A device for fastening an actuator cylinder to an outboard marine motor, comprising:

a fastening rod insertable inside the outboard marine motor, the fastening rod having ends each inserted inside a corresponding housing seat defined in one of two terminal elements, such that the fastening rod has a relative rotation with respect to the two terminal elements, the two terminal elements being fastened to the actuator cylinder, wherein the outboard marine motor is integral with the fastening rod, so that the outboard marine motor is enabled to oscillate around a longitudinal axis of the fastening rod; and an insulating element interposed between each end of the fastening rod and the corresponding housing seat, wherein the insulating element is configured to at least partially surround a surface of each end of the fastening rod, and wherein the insulating element is fastened to inner walls of the corresponding housing seat, so as to be integral with the one of two terminal elements and allow the relative rotation of the fastening rod.

2. A device for fastening an actuator cylinder to an outboard marine motor, comprising:

a fastening rod insertable inside the outboard marine motor, the fastening rod having ends each inserted inside a corresponding housing seat defined in one of two terminal elements, such that the fastening rod has a relative rotation with respect to the two terminal elements, the two terminal elements being fastened to the actuator cylinder, wherein the outboard marine motor is integral with the fastening rod, so that the outboard marine motor is enabled to oscillate around a longitudinal axis of the fastening rod; and an insulating element interposed between each end of the fastening rod and the corresponding housing seat, wherein the insulating element is configured to at least partially surround a surface of each end of the fastening rod, and wherein two insulating elements are provided for each end, the two insulating elements being spaced apart along the longitudinal axis of the fastening rod, lubricating material being interposed between the two insulating elements.

3. The device according to claim 2, wherein the insulating element comprises a bushing element.

4. The device according to claim 1, wherein the corresponding housing seat is shaped as a through-hole obtained in a thickness of the one of two terminal elements, the insulating element having a length equal to a length of the through-hole.

5. A dual-acting actuator cylinder for an outboard marine motor, comprising:

a fastening device according to claim 1, wherein the fastening device is configured to fasten the actuator cylinder to the outboard marine motor.

6. A device for fastening an actuator cylinder to an outboard marine motor, comprising:

a fastening rod insertable inside the outboard marine motor, the fastening rod having ends each inserted inside a corresponding housing seat defined in one of two terminal elements, such that the fastening rod has a relative rotation with respect to the two terminal elements, the two terminal elements being fastened to the actuator cylinder, wherein the outboard marine motor is integral with the fastening rod, so that the outboard marine motor is enabled to oscillate around a longitudinal axis of the fastening rod; and an insulating element interposed between each end of the fastening rod and the corresponding housing seat, the insulating element consisting of a plastic material shaped as a bushing, the insulating element being fitted on each end of the fastening rod arranged in the corresponding housing seat.

7. The device according to claim 6, wherein the corresponding housing seat is shaped as a through-hole obtained in a thickness of the one of two terminal elements, the insulating element having a length equal to a length of the through-hole.

8. The device according to claim 6, wherein the plastic material is an inert plastic polymer.

* * * * *